US007059402B2

(12) United States Patent
Lima et al.

(10) Patent No.: US 7,059,402 B2
(45) Date of Patent: Jun. 13, 2006

(54) METHOD AND APPARATUS FOR EXPLOITING OILFIELDS

(75) Inventors: Paulo César Ribeiro Lima, Brasilia (BR); Alcino R. de Almeida, Rio de Janeiro (BR)

(73) Assignee: Petroleo Brasileiro S.A. - PETROBRAS (BR)

( * ) Notice: Subject to any disclaimer, the term of this patent is extended or adjusted under 35 U.S.C. 154(b) by 0 days.

(21) Appl. No.: 10/996,047

(22) Filed: Nov. 24, 2004

(65) Prior Publication Data

US 2005/0178542 A1 Aug. 18, 2005

Related U.S. Application Data

(63) Continuation of application No. 10/430,390, filed on May 7, 2003, now abandoned.

(30) Foreign Application Priority Data

May 7, 2002 (BR) ..... 0202250

(51) Int. Cl.
*E21B 43/30* (2006.01)
*E21B 43/16* (2006.01)

(52) U.S. Cl. ..... 166/245; 166/268; 166/50; 166/52

(58) Field of Classification Search ..... 166/245, 166/268, 50, 52
See application file for complete search history.

(56) References Cited

U.S. PATENT DOCUMENTS 4,161,047 A 7/1979 Riley
4,390,067 A 6/1983 Willman
4,458,945 A 7/1984 Ayler
4,598,770 A 7/1986 Shu
4,662,441 A 5/1987 Huang
4,696,345 A 9/1987 Hsueh
4,702,314 A 10/1987 Huang
5,074,360 A 12/1991 Guinn
5,211,230 A 5/1993 Ostapovich
5,246,071 A 9/1993 Chu
5,339,897 A 8/1994 Leaute
5,988,278 A 11/1999 Johnson
6,012,520 A 1/2000 Yu
6,095,244 A 8/2000 Graham
6,494,264 B1 12/2002 Pringle
6,585,040 B1 7/2003 Hanton
6,662,870 B1 12/2003 Zupanick
6,729,394 B1 * 5/2004 Hassan et al. ..... 166/245

* cited by examiner

*Primary Examiner*—David Bagnell
*Assistant Examiner*—Shane Bomar
(74) *Attorney, Agent, or Firm*—Nixon & Vanderhye PC

(57) ABSTRACT

A method and apparatus for exploiting oilfields involving the installation of a well network in the form of an open or non-open ring that is generally non-circular. Horizontal well sections (3) are drilled from vertical injection (1) or producing (2) wells that already exist, to interlink them. The vertical wells that are located in the same line are used as injection wells, thereby promoting oil sweeping in the reservoir (R) towards the ring-shaped producing wells (P1) or (P2). In another embodiment, vertical service wells are drilled for monitoring the characteristics of the reservoir (R). From these wells, horizontal wells are drilled in a ring-shaped form to obtain concentric well rings from the periphery to the central region of the reservoir (R). The outermost horizontal well is used as injection well and the innermost annular horizontal wells are used as producing wells.

36 Claims, 8 Drawing Sheets

Prior Art

METHOD AND APPARATUS FOR EXPLOITING OILFIELDS

This application is a continuation of application. Ser. No. 10/430,390, filed May 7, 2003 now abandoned, the entire contents of which are incorporated herein by this reference.

FIELD OF THE INVENTION

The field of application of the present invention is that of systems for optimizing the exploitation of new petroleum reservoirs or reservoirs that are already at the production stage, which make use of artificial recovery and lift operations.

PRIOR ART

Petroleum is found in pressurized accumulations in subsoil permoporous rocks, known to specialists as reservoir rocks.

In order for the petroleum to be recovered, wells are drilled from the surface of the ground until the permoporous rocks are traversed, so as to provide a communication channel between the abovementioned two environments. Next, processing units are installed in order more efficiently to promote the stages of draining and collecting the petroleum that is present in the reservoirs and treating the fluids produced.

A steel pipe, known as a casing, is inserted inside each hole opened in the ground in order to form the wells. Then, one or more pipes of smaller diameter intended for the fluid stream from one or more reservoirs are inserted inside the casing.

The majority of current petroleum-producing wells reach the reservoirs vertically or almost vertically. Therefore, the area open to the flow of the fluids from the reservoir to the inside of the well is at most equal to the external area of the cylinder formed owing to the penetration of the wellhole inside the reservoir.

In actual fact, the abovementioned area open to the flow ends up being much smaller than the external area of the cylinder formed by the penetration of the well owing to a commonly used technique known as perforations or perforated casings, which comprises perforating the well casing with a certain number of holes through which the fluids that exist in the reservoir are drained to the inside of the producing well.

As already stated, the petroleum is under pressure inside the porous rocks. When production commences, the pressure tends to drop or is insufficient for production at a rate of flow that is regarded as economically viable. There is therefore a need to maintain this pressure or to enhance recovery. For this to occur, one of the procedures adopted is to drill wells, similar to producing wells, with the function of injecting fluids, such as water or natural gas, possibly containing additives, inside the reservoir. The fluids injected via the injection well together with the fluid from the reservoir are then collected in the producing well.

Since the vertical or practically vertical wells have a small area of contact with the reservoir, there is a need to impose a high pressure gradient between the reservoir and the well such as, for example, the suction of the fluids by means of a subsurface pump. In this way, the petroleum tends to overcome the resistances imposed by the porous medium and is able to flow to the inside of the well.

However, there is a limit to the values of this pressure gradient and consequently a maximum limit for production flow rates.

In addition, high pressure gradients in the vicinity of the well generate a greater production of sand and fines.

The production of sand and fines may obstruct the narrow pathways that exist between the grains of the reservoir rock, thereby restricting the rate of flow. Also, if an aquifer is present at the base or if there is a layer of gas in the section of the reservoir traversed by the well, the high pressure gradient may, in extreme cases, give rise to the appearance of gas or water conicity phenomena, a situation in which, instead of petroleum, the well produces a large quantity of water or gas, limiting the production flow rate and even causing the producing well to be closed down temporarily or permanently.

Moreover, certain reservoirs are formed by lenticular formations of sediments that appear in isolation in the subsoil, just like large pockets of hydrocarbons. The vertical wells that form the drainage network of these reservoirs may not traverse some of these pockets, which reduces the volume recovered from the reservoir.

In reservoirs to which enhanced-recovery methods are applied, the injected fluids have greater difficulty in displacing the production fluids efficiently from the inside of the reservoir if the injection and producing wells are vertical. Owing to the very great difference between the dimensions of the wells in comparison with the dimensions of the reservoir, injection and production can be said to have properties of a geometric point. The injected fluid is incapable of advancing through the meanderings of the porous medium in a uniform manner. Even supposing that reservoirs were ideally homogeneous and isotropic, i.e. with the same physical properties in all directions, certain regions are swept before others. In heterogeneous and anisotropic reservoirs, the disruptions caused by the preferential paths are drastically amplified.

A little over a decade ago, a solution was adopted to mitigate the problems mentioned above. Wells came to be drilled with a relatively long section having a substantially horizontal orientation inside the reservoir. These wells are known as horizontal wells, but in practice it is only the final part of these that actually penetrates inside the reservoir, where this final part is horizontal or close to horizontal.

Compared with vertical or practically vertical wells, horizontal or practically horizontal wells have the advantage of presenting a much greater area of contact with the reservoir.

For one and the same pressure differential applied to a vertical well, production or injection is much greater in a horizontal well. Moreover, the same production may be obtained with a much smaller pressure differential compared with a vertical well, which enhances control over problems involving the migration of fines and sand, or water or gas conicity phenomena.

Depending on the geological characteristics of a reservoir, for example a number of pockets, fractures or other elements being in communication, the drilling of a horizontal well reaching these areas would be a particular advantage. Similarly, in-line arrangements comprising the drilling of injection and producing wells in line greatly increases the efficiency of sweeping material from inside the reservoir in the case of an enhanced-recovery procedure. The sweeping of material from inside the reservoir will be described only as sweep below. In the case of horizontal wells, the fluids flow hot through the rocks they traverse, avoiding problems with the increase in viscosity on account of a drop in temperature, precipitation of paraffins and other, related problems, which can, in isolation or in combination, reduce or even halt production.

In the case of extended reach horizontal wells, one advantage lies in the capacity to drain reservoirs in environments that are hostile or difficult to access from an initial preferred location. For example, it would be especially advantageous to prospect a reservoir in ultra-deep waters from a platform located in shallow waters. The application of this solution would be ideal in the case of satellite wells, with the fluids flowing through pipes on the sea bed. The greater impediment is the low temperature of the seawater, giving rise to problems of an increase in viscosity and/or some of the other problems described above.

Despite being able to provide greater productivity, horizontal wells involve greater drilling costs and cause difficulties in the operations of completion and stimulation, and, in terms of production, difficulties in terms of customary pumping techniques. Difficulty with pumping may conflict directly with the benefits obtained through well productivity.

A horizontal well presents a greater area of contact with the fluid inside the reservoir, which allows the drainage of distant regions. In the light of this, it would appear to be advantageous for the well to have a horizontal section that is as long as possible inside the reservoir in order to expand the area of contact with the fluid in the reservoir and to drain distant regions. However, the majority of production in a horizontal well takes place in the region where the well initially penetrates inside the reservoir. Therefore, in the case of points inside the well that are distant from the location where the well penetrates the reservoir, the pressure differential between the reservoir and the well is less owing to the loss of head in the flow of fluids inside the well. This fact reduces the inflow of the fluids from the reservoir to the well.

In the case of an injection well with a very long horizontal section, similarly to a producing well described above, operational problems also occur. In order for an adequate flow rate to be maintained at the point most distant from the horizontal section, the required pressure for injection has to reach very high values, and the pressure gradient along this section is also very great, which makes controlling the injection flow rate difficult. Therefore, out-of-balance injections may occur, adversely affecting sweep efficiency. There is thus a length that is regarded as optimum for the horizontal section, up to which productivity gains are not cancelled out by the costs of drilling and completion.

A reservoir may be penetrated by a number of vertical or practically vertical wells containing horizontal or practically horizontal sections. Some of these wells may have the function of injection or production. Depending on the characteristics of the reservoir and of the recovery procedures, there may be arrangements at the location of these wells such that the benefits of the length of the horizontal section, as stated above, combined with the parameters of control of pressure, flow rate and production, are close to maximum efficiency.

Examples of enhanced recovery and other operations for achieving more efficient petroleum production using such arrangements may be found in documents U.S. Pat. No. 4,161,047, U.S. Pat. No. 4,662,441, U.S. Pat. No. 4,702,314 and U.S. Pat. No. 5,246,071. It should be pointed out once again that the above documents refer to restricted arrangements for improving secondary recovery of petroleum in a field that is already drained, which differs from the proposal of the present invention, which presents an integrated system for improving the production of an oilfield that is developed, under development or to be developed.

In the case of oilfields that are at a development stage, the solution of horizontal wells is highly attractive, especially in a deep-water environment. However, in those fields that are already developed, with hundreds of wells drilled and already used for enhanced-recovery procedures, such a solution is difficult to set up. The initially high costs may compromise the already constrained cash flow of such depleted fields and cancel out any gain afforded by the greater productivity of the wells and the improved sweep efficiency.

Therefore, there is a need for a novel solution to the problem of exploiting a petroleum reservoir efficiently and one that allows the application of enhanced-recovery methods in an equally efficient manner, plus a solution that is suited to the drainage arrangements that exist in reservoirs that are already developed and that incorporates an efficient artificial lift method that is low in cost and has a high level of operational reliability.

The exploitation system of the present invention incorporates, in a manner not hitherto known, an alternative arrangement for secondary or special recovery by means of an optimized artificial lift method. Additionally, the system allows an appreciable reduction in operating costs, especially owing to the possibility of centralizing production operations.

SUMMARY OF THE INVENTION

The present invention relates to a system for exploiting oilfields, be these developed or to be developed.

Although the present invention relates primarily to petroleum wells, said wells possibly being associated with gas, be these gas wells with condensate or without condensate, it may be applied to the draining of any fluids stored in underground reservoir rocks.

In essence, the system comprises the installation of a network of wells in the form of an open or non-open ring that is generally non-circular, said wells possibly being combined with in-line wells.

In the case of fields that are already developed, horizontal well sections are drilled from the already existing vertical wells so as interlink the latter, intercalated, in line or in the form of a ring. The vertical wells that are located along the ring configuration may, in the case of all or at least some of them, be used for draining the reservoir. The vertical wells not used for drainage are used as breathers, in order to relieve the pressure in the horizontal ring well and to allow adequate feed of the fluids in the reservoir over the entire extent of the ring. The vertical wells that are located in one and the same line are used as injection wells, to promote sweeping of oil towards the horizontal ring producing wells.

In the case of a new field, vertical service wells are drilled for monitoring the characteristics of the reservoir. From these, horizontal ring wells are drilled in such a manner that concentric rings are obtained from the periphery to the most central region of the reservoir. The outermost annular horizontal well can be used as an injection well and the innermost annular horizontal wells are used as producing wells. Just as for fields that are already developed, at least some of the vertical wells may be used as breathers to relieve the pressure in the annular horizontal well associated with said vertical wells. As soon as the reservoir has been drained, the outermost annular wells switch function, changing from producing into injection wells.

The system of the present invention also allows collection of petroleum, and fluid injection may be promoted from a single point on the surface, either a land-based station or an offshore platform, use being made of an artificial fluid-lift method, such as, for example, intermittent pneumatic pumping with or without the presence of a rigid or flexible mechanical interface, in an operation similar to the known passage of pigs in oil or gas pipelines.

Centralization of such operations facilitates operational logistics, reduces operating costs and allows easier automated control.

The system promotes more uniform injection fronts. Therefore, use may be made of enhanced-recovery methods with high sweep efficiency, which improves the reservoir recovery factor with possible savings in terms of the chemicals involved in this procedure.

BRIEF DESCRIPTION OF THE DRAWINGS

The characteristics of the system for exploiting oilfields, which is the subject of the present invention, will be better appreciated on the basis of the following detailed description that will be given purely by way of example in association with the drawings described below, which are an integral part of the present specification.

DETAILED DESCRIPTION OF THE INVENTION

The detailed description of the system for exploiting oilfields, which is the subject of the present invention, will be given in accordance with the identification of the components that form it, based on the above-described figures.

As already stated above, the present invention makes use of a combination of horizontal wells with an in-line configuration or an open-ring configuration, be the ring circular or non-circular. The injection of fluids for enhanced recovery takes place in line or in outer rings, or rings intercalated with horizontal producing wells, in accordance with the application scenario.

The exploitation system may be applied both to a situation of developing a reservoir and to fields that are already developed.

By way of example and for improved understanding of the present invention, one of the injection and drainage arrangements using vertical wells that exist in the state of the art will be selected.

The arrangement that will be used is known by specialist as five-spot, but the present invention may be applied to other patterns, such as direct-line, seven-spot, nine-spot, etc.

In order to improve understanding of the explanations that will follow the arrangement and its components must be regarded as hypothetical and ideal. In other words, the wells are perfectly vertical, the five-spot arrangement is perfect and the reservoir is perfectly horizontal and homogeneous.

Figure 1:
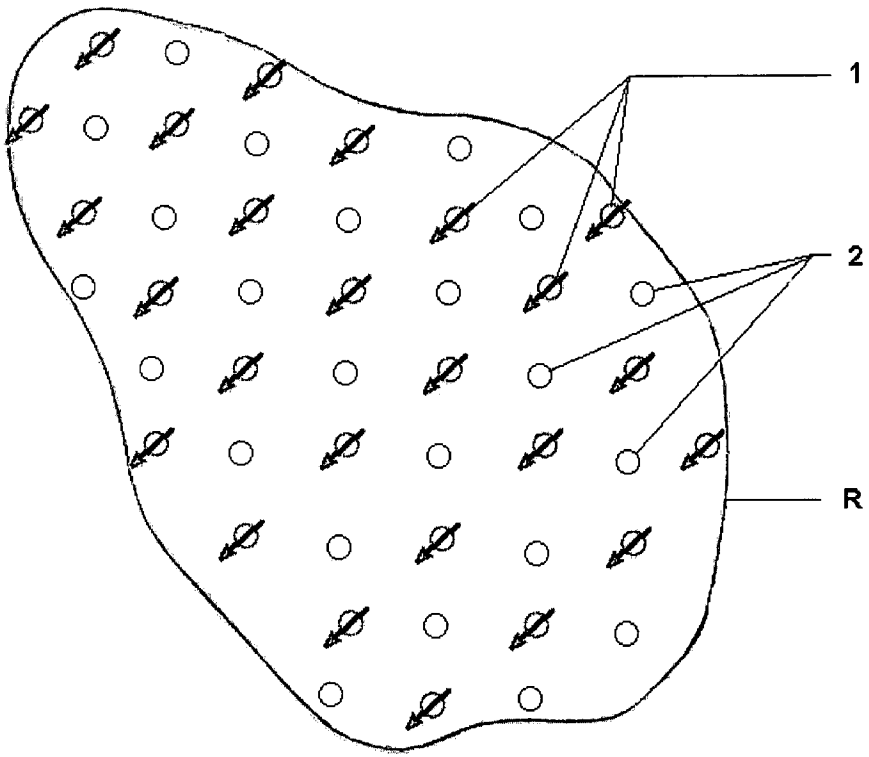
Prior Art FIG. 1
FIG. 1 shows a hypothetical petroleum reservoir penetrated by substantially vertical wells in a pattern or arrangement known within the state of the art as five-spot.

FIG. 1 shows a petroleum reservoir (R), representing the well projections in an imaginary plane perpendicular to the vertical injection wells (1) and the vertical producing wells (2). It should be pointed out that, in this representation, the diameter of the wells is not to scale, in order to improve comprehension. The vertical injection wells (1) and the vertical producing wells (2) are arranged in lines and columns that are equidistant and alternate in each line and in each column. Around one of the vertical injection wells (1) are four vertical producing wells (2), forming a five-spot pattern.

Figure 2:
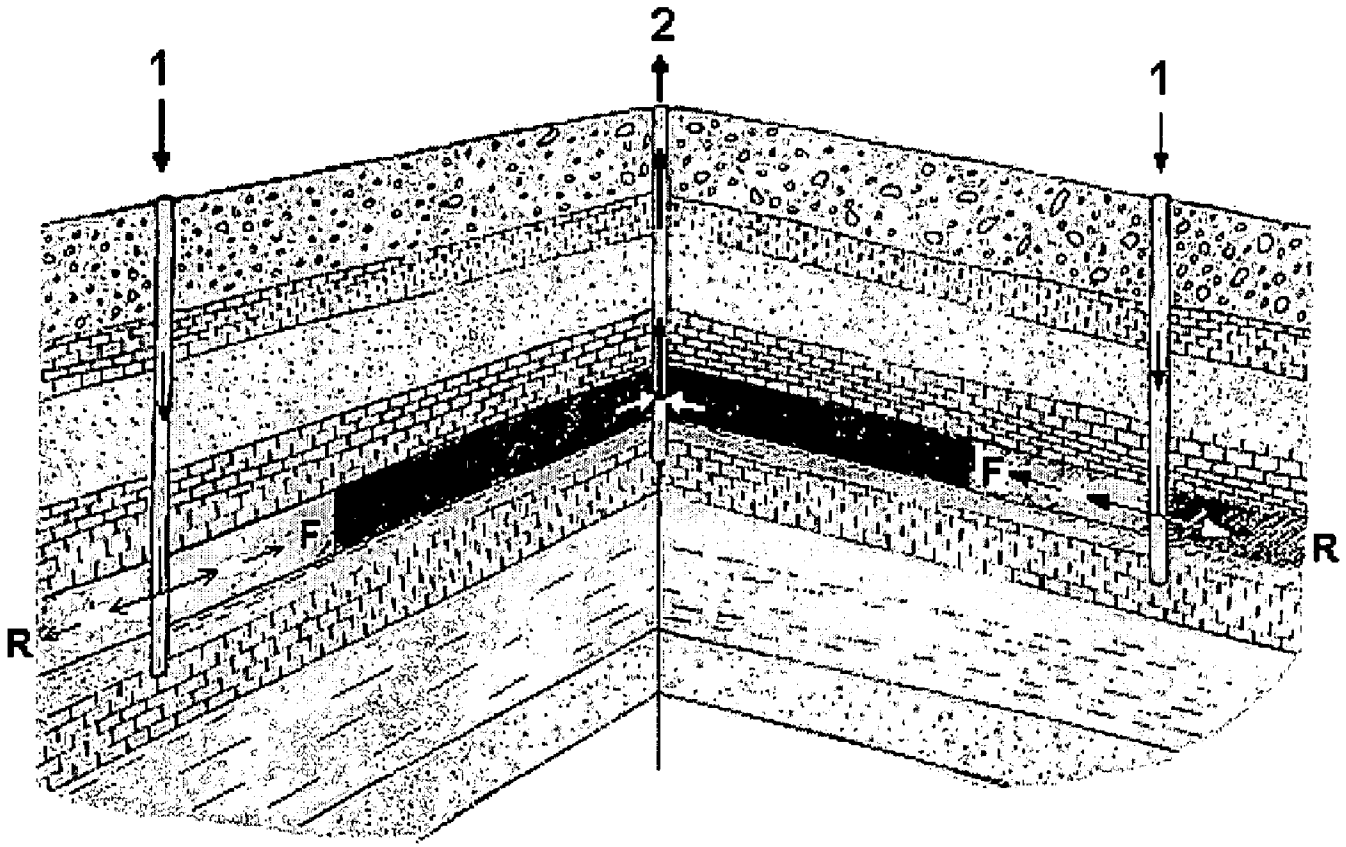
FIG. 2 shows, in an illustrative manner, in section, what happens in a petroleum reservoir developed under a five-spot pattern of FIG. 1 when an enhanced-recovery procedure is applied to it.

In FIG. 2, it is possible to observe, in an illustrative manner, what takes place in the case of a five-spot pattern. A vertical producing well (2) and two vertical injection wells (1) close to the vertical producing well (2) are shown. The fluid injected into the reservoir (R) by means of the vertical injection wells (1) moves in all directions and moving fluid fronts (F) form. These fronts (F) sweep the reservoir (R) and displace the petroleum from the porous medium towards the vertical producing well (2). The fluid injected in each vertical injection well (1) is divided equally between the four nearby neighbouring vertical producing wells (2).

Figure 3:
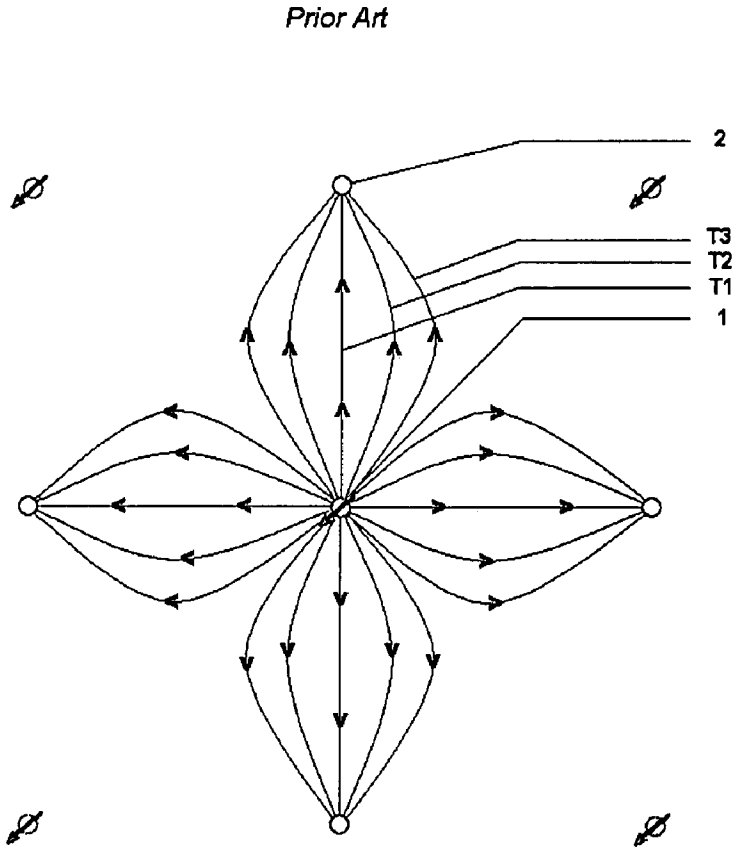
FIG. 3 diagrammatically shows the behaviour of a flow in an ideal five-spot pattern.

FIG. 3 diagrammatically shows the pathways followed by the fluid particles, from a vertical injection well (1) to the four nearby neighbouring vertical producing wells (2). It is possible to see that, even if the injection flow rate is constant, the fluid particle that follows a first pathway (T1) will arrive at the vertical producing well (2) before the fluid particle that follows a second pathway (T2). In turn, the fluid particle that follows the second pathway (T2) will arrive at the vertical producing well (2) before the fluid particle that follows a third pathway (T3). Thus, the injected fluid does not sweep the reservoir (R) uniformly, even given the considerations that were adopted previously in respect of the ideal nature of the scenario.

Figure 3A:
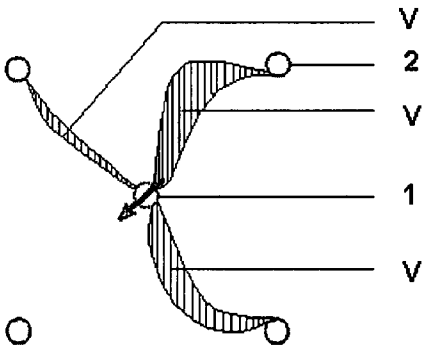
Prior Art FIG. 3A
FIG. 3A diagrammatically shows an example of a drainage profile of an actual five-spot pattern.
Figure 3B:
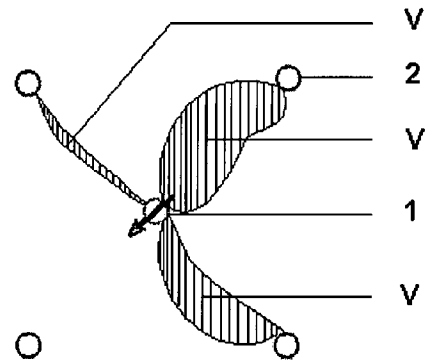
Prior Art FIG. 3B
FIG. 3B diagrammatically shows the drainage profile of the five-spot arrangement of FIG. 3A after a specific injection time has elapsed.

FIGS. 3A and 3B diagrammatically show a possible example of a drainage profile in a reservoir (R) that is heterogeneous and anisotropic, i.e. a reservoir (R) found in reality, a point with the five-spot pattern used as example being observed. FIG. 3A shows possible sweep (V) areas at a specific moment. FIG. 3B shows the possible sweep (V) area after a certain injection time has elapsed. It may be seen in this case that, in addition to the sweep (V) taking place in some regions before others, it may be noted that there are preferential pathways that distort the drainage of the well, leaving regions with oil trapped in the permoporous formations.

In practice, the injection (1) or producing (2) wells are not exactly vertical and do not reach the reservoir (R) at points that form a perfect five-spot pattern. Additionally, a reservoir (R) usually has characteristics such as heterogeneities and fractures that give rise to the appearance of preferential pathways and, consequently, a fluid-particle-movement configuration that is more distorted still.

The drilling of horizontal wells is a possible solution for improving the efficiency of the sweep (V).

Figure 4A:
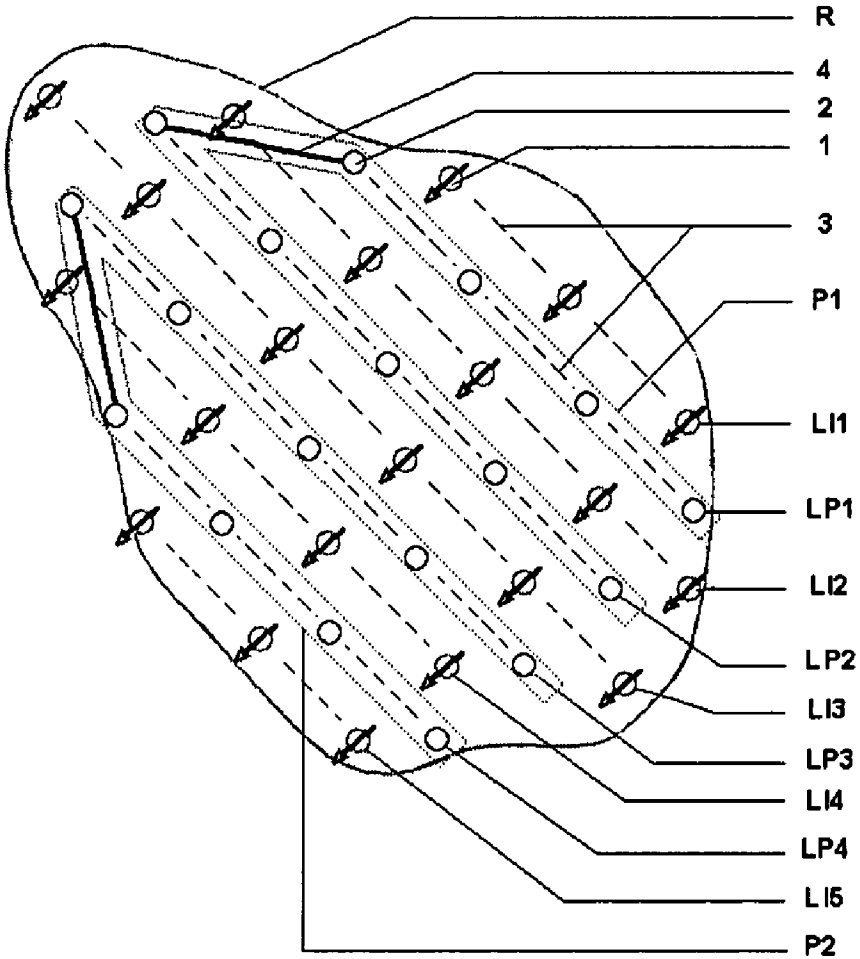
FIG. 4A shows a drainage arrangement for the hypothetical petroleum reservoir of FIG. 1, which uses a pre-existing pattern of substantially vertical wells that penetrate the abovementioned reservoir.

A possible embodiment of the exploitation system of the present invention will now be addressed, in the case of fields that are already developed (that are mature), which may be followed with the aid of FIG. 4, the hypothetical field adopted in FIG. 1 still being considered. This field already has a pattern or arrangement of producing and injection wells set up. Each of the vertical injection wells (1) and vertical producing wells (2) are equipped with their respective injection lines, which convey the fluid for injection from its compression point to the vertical injection wells (1), and the production lines that convey the fluid produced from the vertical producing wells (2) to the collection point(s). The injection and production lines are not shown in this FIG. 4.

The exploitation system that is the subject of the present invention comprises the following stages:

- drilling sections of horizontal wells (3) in such a way as to interlink the vertical injection wells (1), forming substantially parallel injection lines (LI1), (LI2), (LI3), (LI4) and (LI5);
- drilling sections of horizontal wells (3) in such a way as to interlink the vertical producing wells (2), forming substantially parallel production lines (LP1), (LP2), (LP3) and (LP4);
- inserting a production pipeline or tubing (4) inside the casing of the parallel production lines (LP1) and (LP2) or (LP3) and (LP4), in pairs, such that, at the ends, a section of the production pipeline (4) is on the surface;
- installing check valves (5) (not shown) at points on the production pipeline (4) inside the lines (LP1) and (LP2) or (LP3) and (LP4), at locations that preferably coincide with the position of the vertical producing wells (2).

Still observing FIG. 4, it will be noted that, once the above stages have been completed, the parallel injection lines (LI1), (LI2), (LI3), (LI4) and (LI5) are converted into five in-line injection wells, and the parallel production lines (LP1) and (LP2) or (LP3) and (LP4) are converted into two producing ring wells (P1) and (P2) owing to the interlinking of the parallel production lines (LP1) and (LP2) and the parallel production lines (LP3) and (LP4) by means of the production pipelines (4).

Figure 4B:
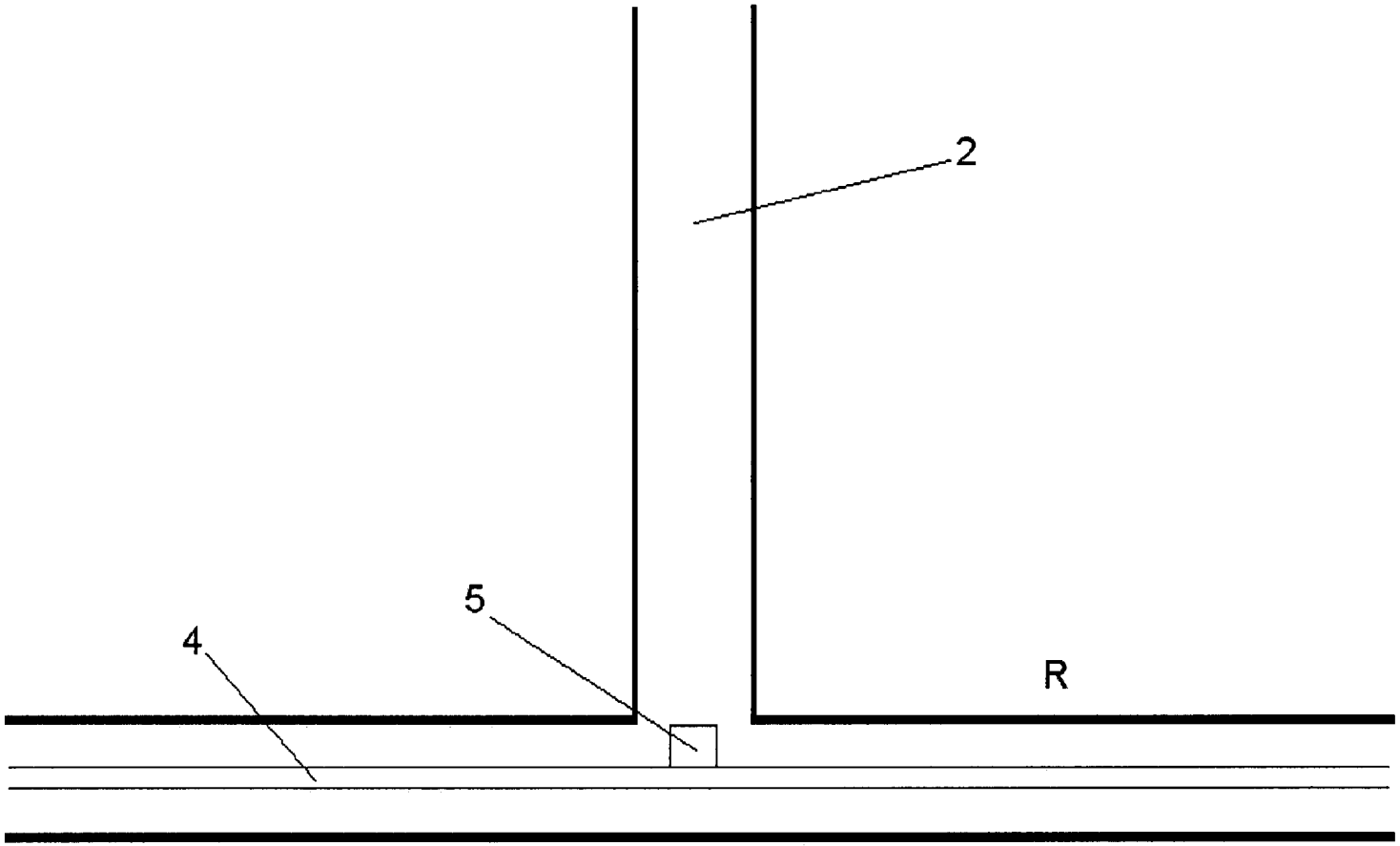
FIG. 4B shows a schematic cutaway view of a vertical production well and the horizontal section.
Figure 5:
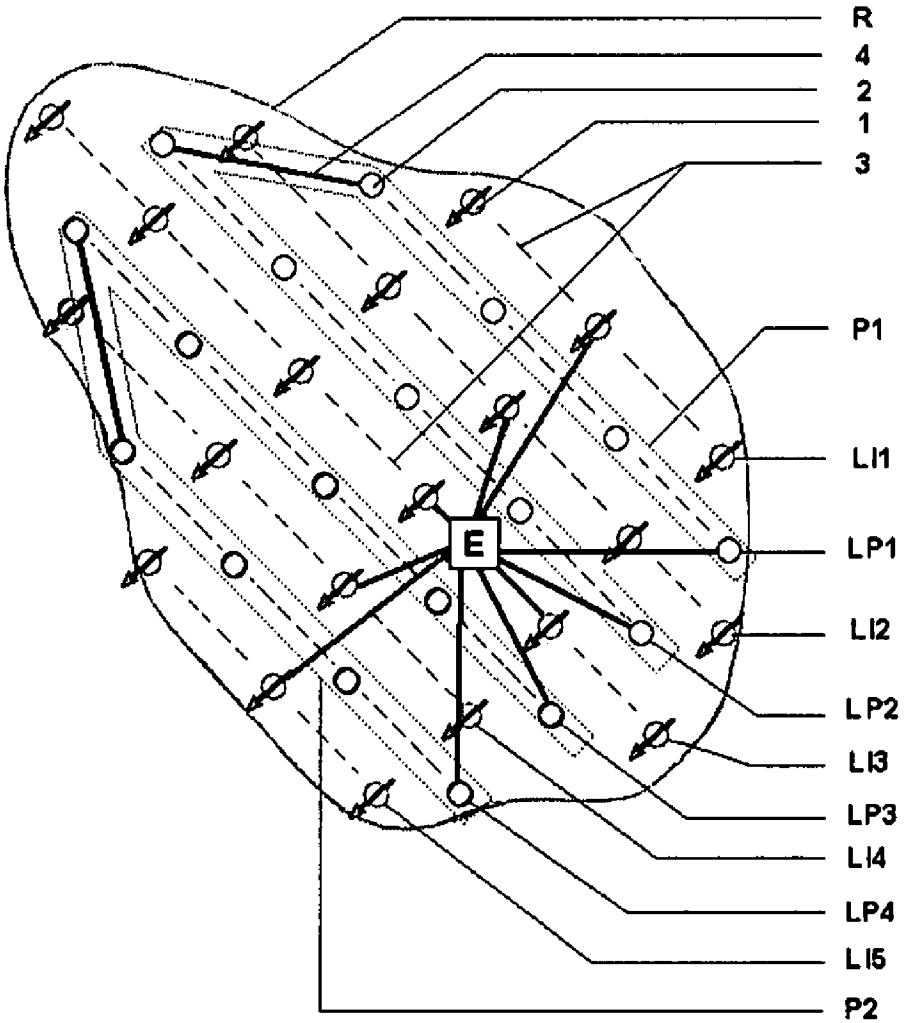
FIG. 5 shows a drainage arrangement for the hypothetical petroleum reservoir of FIG. 4, using the possibility of centralizing injection and production.

The producing ring wells (P1) and (P2), in order for it to be clearer, are located, in the representation in FIGS. 4 and 5, inside the dotted lines.

Along this producing ring well (P1) or (P2), which encompasses a group of vertical producing wells (2), at least some of the latter will be used as breathers. These breathers are used to promote the relieving of the pressure in the horizontal well sections (3), allowing uniform, maximized fluid intake, even when there are long lengths of such horizontal well sections (3). It should be pointed out that the former production lines of the vertical wells, now acting as breathers, are connected to a separator or tank maintained at a relatively low pressure.

As shown in FIG. 4B, the check valves (5) installed at points on the production pipeline (4), which are in a position that preferably coincides with the position of the vertical production wells (2), are used to control the intake of fluids from the reservoir (R) to the inside of production channel (4).

Fluids may preferably be injected inside the reservoir (R) by means of only one of the vertical injection wells (1) of those that make up a parallel injection line, or by means of the injection pipes that already exist in each of the vertical injection wells (1) that are in one and the same parallel injection line (LI1), (LI2), (LI3), (LI4) or (LI5).

Both oil production and fluid injection into the reservoir (R) may be controlled in each of the parallel injection lines (LI1), (LI2), (LI3), (LI4) or (LI5) or in each of the parallel production lines (LP1), (LP2), (LP3) or (LP4), as illustrated in FIG. 4, or could be controlled from a central controller unit (E), such as, for example, a land-based collection and processing station, which may be seen in the example of FIG. 5, or an offshore central platform. In the case of a field that is already developed, use may be made of one of the already existing collection and processing points, with the unit installed over the region of this field.

There may be situations in which there is more than one producing zone in the same oilfield. In such a case, the rings of producing wells (P1) or (P2) are located at different depths in order to drain respective producing zones.

A second embodiment of the present invention will now be addressed, in connection with a situation involving the development of a new reservoir (R).

In the development of a new reservoir (R), there is greater freedom in terms of the installation of the well pathways. Characteristics peculiar to the reservoir (R) may be taken into account both in the drainage pattern and in the enhanced-recovery pattern, if the latter is necessary.

Figure 6:
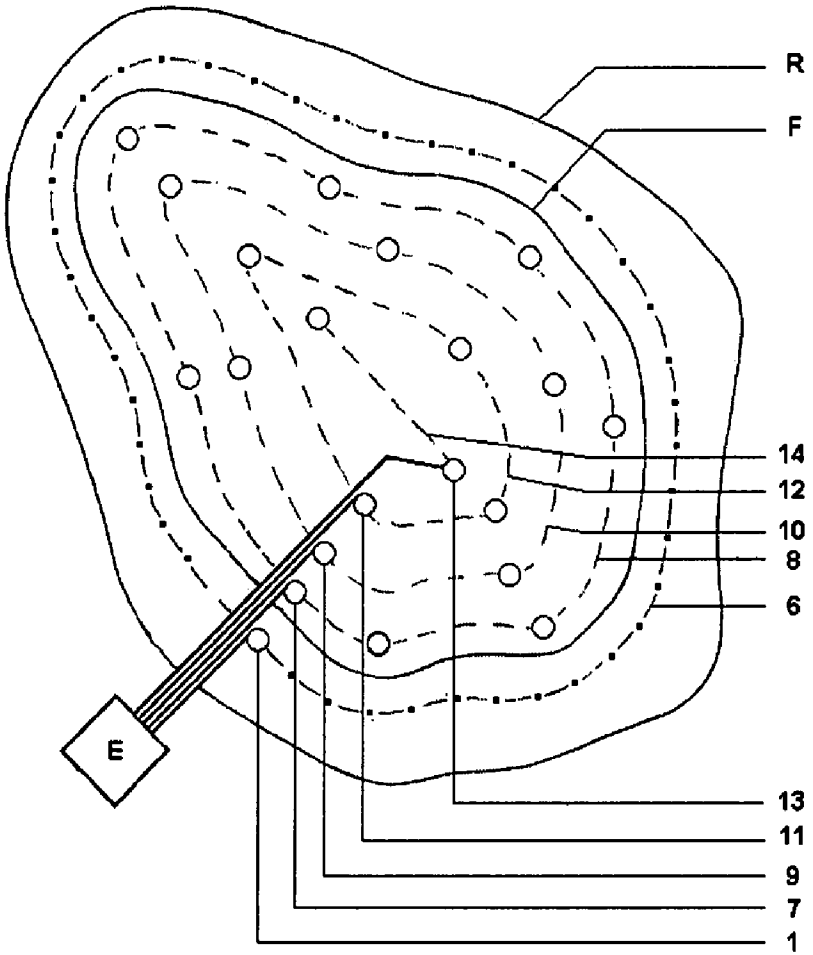
FIG. 6 shows a drainage arrangement for a hypothetical petroleum reservoir that has still not been developed and has an active aquifer.

With the aid of FIG. 6, a possible application of the system that is the subject of the present invention may be seen. Purely by way of simplification, a hypothetical reservoir (R) that has an active aquifer should be considered in this case.

The system in this scenario comprises:

- a central controller unit (E) that carries out the operations of injection of fluids into the reservoir, control of an intermittent pneumatic method for production and collection of the production;
- a vertical injection well (1), drilled at a location close to the periphery of the reservoir and connected to the injection line of the central controller unit (E);
- a horizontal injection well (6), linked to the vertical injection well (1), drilled so as to be substantially ring-shaped, following the geometry of the water/oil interface at the periphery of the reservoir (R);
- a first group of vertical producing wells (7) drilled inside the area delimited by the horizontal injection well (6);
- a first horizontal producing well (8), drilled in the form of a ring, inside the area delimited by the horizontal injection well (6), interlinking the first group of vertical producing wells (7);
- a second group of vertical producing wells (9) drilled inside the area delimited by the first horizontal producing well (8);
- a second horizontal producing well (10), drilled in the form of a ring, inside the area delimited by the first horizontal producing well (8), interlinking the second group of vertical producing wells (9);
- a third group of vertical producing wells (11) drilled inside the area delimited by the second horizontal producing well (10);
- a third horizontal producing well (12), drilled in the form of a ring, inside the area delimited by the second horizontal producing well (10), interlinking the third group of vertical producing wells (11);
- a fourth group of vertical producing wells (13) drilled inside the area delimited by the third horizontal producing well (12);

a fourth horizontal producing well (14), drilled in line, inside the area delimited by the third horizontal producing well (12) in a region close to the centre of the reservoir (R), interlinking the fourth group of vertical producing wells (13).

The horizontal producing wells (8), (10), (12) or (14) are drilled with the aid of the groups of vertical producing wells (7), (9), (11) or (13).

The groups of vertical producing wells (7), (9), (11) or (13) comprise at least two vertical wells.

At least one well in the group of vertical producing wells (7), (9), (11) or (13) is used for the collection of production.

The remaining wells in a single group of vertical producing wells (7), (9), (11) or (13) are kept open as breathers and are used to promote the relieving of pressure in the segments of the horizontal well, allowing, even in the case of long lengths of such segments of horizontal well, a uniform, maximized fluid intake.

The horizontal producing ring wells (8), (10), (12) or (14) may present pathways that are easier to drill, with improved utilization of some of the characteristics of the reservoir.

The horizontal producing ring wells (8), (10), (12) or (14) may be shortened with production lines on the surface that link some of the wells in the group of vertical producing wells (7), (9), (11) or (13) to the central controller unit (E), dividing a horizontal producing well (8), (10), (12) or (14) into two.

The injection of water, preferably with the addition of polymers, from the central controller unit (E) to the horizontal injection well (6) forces the moving fluid front (F) inside the reservoir (R) to move the oil towards the first horizontal producing well (8) until this first horizontal producing well (8) begins to produce practically water and, as of that moment, this horizontal producing well (8) is converted into an injection well, with continuity of the movement of the oil towards the second horizontal producing well (10) until water is produced, to be then converted into an injection well and so on in succession as far as the fourth horizontal producing well (14), sweeping the entire reservoir (R).

If the sweep (V) does not take place in the anticipated manner, one of the annular horizontal wells (8), (10), (12) or (14) may, at the same time, be producing in a specific segment and injecting in another segment of the same well, with the insertion of injection and production pipes in each of the segments and the installation of equipment that isolates the producing segment from the injecting segment.

An artificial lift system is used in the case of either of the two embodiments described above. Intermittent pneumatic pumping, with or without a mechanical interface, is used principally when the reservoir (R) is already being prospected or is new, given that they are barely or moderately productive, for example when the production pressure is insufficient for the oil to be lifted spontaneously. Taking as a basis the first embodiment with the intermittent lift system, the reservoir (R) is enabled to feed the wells for a certain period (rest period). During this time period, the fluids coming from the reservoir (R) would fill the producing ring wells (P1) and (P2), some of the vertical producing wells (2) and the production pipeline (4) that runs through the inside of the annular producing wells (P1) and (P2). When the rest period has ended, rigid or flexible mechanical interfaces would be launched from the central controller unit (E) through the inside of each of the production pipelines (4), impelled by a fluid at high pressure, carrying along all the fluid that has accumulated inside said pipelines during the rest period as far as the central controller unit (E). After this procedure there follows a depressurization of the system, a new production cycle being initiated with a further rest period. The check valves (5) already mentioned above prevent both the fluid carried along by the mechanical interface and the fluid that impels said interface from flowing out of the production pipelines (4).

In a field with a reservoir (R) that has a production pressure capable of lifting the oil to the surface, pneumatic pumping is not used as the passage of a mechanical interface would restrict production.

In the description given up to this point of the system for exploiting oilfields, which is the subject of the present invention, the aspects addressed must be regarded only as possible embodiments, and any particular characteristics introduced therein, such as, for example, locations and quantities that are determined by various factors peculiar to the field in which they will be applied, must be understood only as something described in order to facilitate comprehension. Therefore, they may in no way be regarded as limiting the invention, the latter being limited only by the scope and spirit of the following claims.

What is claimed is:

1. A method for exploiting an already developed oilfield, for optimizing the draining of the reservoirs, said oilfield comprising a plurality of vertical injection wells and a plurality of vertical production wells, said method comprising:

drilling sections of horizontal injection wells to join the vertical injection wells, said horizontal injection wells that join the vertical injection wells forming substantially parallel injection lines;

drilling sections of horizontal production wells to join the vertical producing wells, said horizontal production wells that join the vertical production wells forming substantially parallel production lines;

whereby both horizontal and vertical wells are configured to be a network of in-line injection lines, or ring-shaped production lines.

2. A method for exploiting oilfields according to claim 1, further comprising:

inserting a production pipeline inside the casing of the parallel production lines, in pairs, so that, at the ends, a section of the production pipeline is on the surface;

installing check valves at points on the production pipeline inside the lines.

3. A method for exploiting oilfields according to claim 2, wherein said check valves are installed at locations that substantially coincide with the position of the vertical producing wells.

4. A method for exploiting oilfields according to claim 2, wherein the parallel production lines are converted into ring-shaped producing wells by the joining of the parallel production lines by means of the production pipelines.

5. A method for exploiting oilfields according to claim 4, wherein along the ring-shaped producing wells formed by the group of vertical producing wells, at least some of the latter are used as breathers.

6. A method for exploiting oilfields according to claim 5, wherein the breathers are used to promote the relieving of pressure in the horizontal production well sections, allowing uniform, maximized fluid intake, even when there are long lengths of such horizontal production well sections.

7. A method for exploiting oilfields according to claim 2, wherein the check valves installed at points on the production pipeline are used to control the intake of fluids from the reservoir to the inside of the production pipeline.

8. A method for exploiting oilfields according to claim 2, wherein the check valves installed at points on the production pipeline are used to block the flow of fluids from the inside to outside of the production pipeline.

9. A method for exploiting oilfields according to claim 1, further comprising injecting fluids inside the reservoir using only one of the vertical injection wells of those that make up a single parallel injection line.

10. A method for exploiting oilfields according to claim 1, further comprising injecting fluids inside the reservoir using the pipes that already exist in each of the vertical injection wells of those that make up a single parallel injection line.

11. A method for exploiting oilfields according to claim 1, further comprising controlling oil production and controlling fluid injection into the reservoir in each of the parallel injection lines and each of the parallel production lines.

12. A method for exploiting oilfields according to claim 1, wherein oil production and fluid injection into the reservoir are controlled from a central controller unit.

13. A method for exploiting oilfields according to claim 12, wherein the central controller unit is a land-based collection and processing station.

14. A method for exploiting oilfields according to claim 12, wherein the central controller unit is an offshore central platform.

15. A method for exploiting oilfields according to claim 1, wherein the horizontal producing wells are located at different depths in order to drain producing zones that are at different depths.

16. A method for exploiting oilfields according to claim 1, further comprising inserting a production pipeline inside the parallel production lines in pairs such that a section of the production pipeline is on the surface extending between the parallel production lines.

17. A method for exploiting oilfields according to claim 16, wherein the respectively parallel pairs of production lines are each converted into a production ring well owing to the interlinking of said parallel production lines by means of the respective production pipelines.

18. A method for exploiting oilfields according to claim 16, further comprising using an artificial lift system in reservoirs that are barely or moderately productive.

19. A method for exploiting oilfields according to claim 18, wherein rigid or flexible mechanical interfaces are launched through the inside of each of the production pipe lines, impelled by a fluid at high pressure, carrying along all the fluid that has accumulated inside said pipe lines.

20. A method for exploiting oilfields according to claim 19, wherein the fluid at a high pressure is impelled by an intermittent pneumatic pumping system.

21. A method for exploiting a new oilfield, for optimizing the draining of the reservoirs, said method comprising:

drilling a vertical injection well;

drilling a horizontal injection well linked with said vertical injection well;

drilling a first group of vertical producing wells;

drilling a first horizontal producing well interlinked with said first group of vertical producing wells, wherein both vertical and horizontal injection wells are drilled so as to be substantially ring-shaped, following the geometry of the water/oil interface at the periphery of the reservoir.

22. A method according to claim 21, wherein said first group of vertical producing wells are drilled inside the area delimited by the horizontal injection well.

23. A method according to claim 22, wherein said first horizontal producing well is drilled in the form of a ring, inside the area delimited by the horizontal injection well.

24. A method according to claim 23, further comprising:

drilling a second group of vertical producing wells inside the area delimited by the first horizontal ring-shaped producing well;

drilling a second horizontal producing well in the form of a ring, inside the area delimited by the first horizontal ring-shaped producing well, interlinking the second group of vertical producing wells.

25. A method according to claim 24, further comprising:

drilling successively a plurality of horizontal producing wells in the form of a ring, each one inside the area delimited by the nearby outside horizontal ring-shaped producing well, interlinking a group of vertical producing wells previously drilled inside the area delimited by the said nearby outside horizontal ring-shaped producing well.

26. A method according to claim 25, further comprising:

establishing the number of horizontal ring-shaped producing wells to be drilled based on reservoir characteristics and economical analysis.

27. A method according to claim 25, further comprising:

drilling a group of vertical producing wells inside the area delimited by the innermost horizontal ring-shaped producing well;

drilling a horizontal producing well in line, inside the area delimited by the innermost horizontal producing well in a region close to the centre of the reservoir, interlinking the said group of vertical producing wells.

28. A method for exploiting oilfields according to claim 24, wherein groups of vertical producing wells comprise at least two vertical wells.

29. A method for exploiting oilfields according to claim 24, wherein at least one well in one of the groups of vertical producing wells is used for collecting production fluids.

30. A method for exploiting oilfields according to claim 29, wherein the remaining wells in said group of vertical producing wells are kept open as breathers.

31. A method for exploiting oilfields according to claim 30, wherein the breathers are used to promote the relieving of pressure in the segments of horizontal well such that there is a uniform, maximized fluid intake.

32. A method for exploiting oilfields according to claim 24, wherein the horizontal producing well is shortened by means of production lines on the surface that link one of the wells in the group of vertical producing wells to a central controller unit and divide a horizontal producing well into two.

33. A method for exploiting oilfields according to claim 24, further comprising injecting water from the central controller unit to the horizontal injection well so as to force the moving fluid front inside the reservoir to move the oil towards the first horizontal producing well until this first horizontal producing well begins to produce practically water and, as of that moment, converting that horizontal producing well into an injection well, with continuity of the movement of the oil towards the second horizontal producing well until water is produced, to be then converted into an injection well and so on in succession as far as the last horizontal producing well, sweeping the entire reservoir.

34. A method for exploiting oilfields according to claim 21, wherein the first horizontal producing well is drilled so as to be substantially ring-shaped with the aid of the first group of vertical producing wells.

35. A method for exploiting oilfields according to claim 21, wherein the first horizontal producing well may, at the same time, be producing in a specific segment and injecting in another segment, the method further comprising the insertion of injection and production pipes in each of the segments and the installation of equipment that isolates the producing segment from the injecting segment.

36. An oilfield exploitation apparatus comprising:

a central controller unit that carries out the operations of injection of fluids into the reservoir, control of an intermittent pneumatic method for production and collection of the production fluids;

a vertical injection well, drilled at a location close to the periphery of the reservoir and connected to the injection line of the central controller unit;

a horizontal injection well, linked to the vertical injection well, drilled so as to be substantially ring-shaped, following the geometry of the water/oil interface at the periphery of the reservoir;

a first group of vertical producing wells drilled inside the area delimited by the horizontal injection well;

a first horizontal producing well, drilled in the form of a ring, inside the area delimited by the horizontal injection well, interlinking the first group of vertical producing wells;

as many as necessary horizontal producing wells, drilled in the form of a ring, inside the area delimited by the nearby outer horizontal producing well, interlinking a group of vertical producing wells previously drilled inside the area delimited by the nearby outer horizontal producing well;

a group of vertical producing wells drilled inside the area delimited by the innermost horizontal ring-shaped producing well;

a horizontal producing well, drilled in line, inside the area delimited by the innermost horizontal ring-shaped producing well in a region close to the centre of the reservoir, interlinking the said group of vertical producing wells.

* * * * *